United States Patent [19]

Jones

[11] Patent Number: 4,690,294

[45] Date of Patent: Sep. 1, 1987

[54] BEVERAGE CONTAINER

[76] Inventor: Robert D. Jones, 201 S. Creekdale Dr., #908, Norman, Okla. 73069

[21] Appl. No.: 771,620

[22] Filed: Sep. 3, 1985

[51] Int. Cl.[4] ..... A47G 19/22

[52] U.S. Cl. ..... 220/90.2; 229/7 S

[58] Field of Search ..... 220/90.2; 229/7 S; 215/1 A

[56] References Cited

U.S. PATENT DOCUMENTS

| | | | |
|---|---|---|---|
| 2,547,362 | 4/1951 | Berry | 229/7 S |
| 3,215,329 | 11/1965 | Pugh, Sr. | 229/7 S |
| 3,717,476 | 2/1973 | Harvey | 229/7 S X |
| 3,946,895 | 3/1976 | Pugh | 229/7 S X |
| 4,078,692 | 3/1978 | Stein | 229/7 S X |
| 4,226,356 | 10/1980 | Lemelson | 220/90.2 X |
| 4,305,521 | 12/1981 | Komatsuta et al. | 229/7 S X |
| 4,356,927 | 11/1982 | Cooper et al. | 229/7 S X |
| 4,424,913 | 1/1984 | Ko | 220/90.2 |
| 4,462,503 | 7/1984 | Raffaele | 229/7 S X |
| 4,537,324 | 8/1985 | Wang | 229/7 S X |

*Primary Examiner*—Steven M. Pollard
*Attorney, Agent, or Firm*—Glen M. Burdick

[57] ABSTRACT

An improved container for beverages where the contents of the container can be removed through the use of a flexible tubular member extendible through a pour opening formed in the container when a closure strip of the container is separated therefrom. The improved container comprises a cylindrical body having a first end and a second end; a substantially laterally disposed first disk sealingly connected to one of the first and second ends of the cylindrical body; a substantially laterally disposed second disk sealingly connected to the other of the first and second ends of the cylindrical body, the second disk having a pour opening formed therein; a closure strip assembly supported by the second disk for sealingly closing the pour opening, the closure strip assembly manually separable from at least a portion of the second disk so as to permit access to contents within the container via the pour opening; a flexible tubular member disposed within the container so as to be extendible through the pour opening when the closure strip assembly is separated from the second disk, the flexible tubular member having a first end portion, a second end portion, and an extendible length greater than the length of the cylindrical body; and, a stabilizing and aligning assembly for stabilizing the flexible tubular member within the container and for aligning one end of the flexible tubular member with the pour opening such that upon removal of the flexible strip assembly one end of the flexible tubular member is extendible through the pour opening.

2 Claims, 8 Drawing Figures

BEVERAGE CONTAINER

BACKGROUND OF THE INVENTION

1. Field of the Invention

The present invention relates generally to the field of containers, and more particularly, but not by way of limitation, to beverage containers having pull-ring closures incorporated into the lid of the container.

2. Discussion of Prior Art

For a number of years beverages, such as carbonated beverages, have been sold in non-returnable containers fabricated of aluminum and steel. Basically, two types of pull-ring closures have been used to seal the containers. One type of pull-ring closure utilizes a pull-tab consisting of a strip of metal defined by score lines. The pull tab is separable from the lid of the container to provide an opening in the container by applying a pulling action on the pull tab. The removed tab is then discarded leaving the opening defined by exposed metal edges. To remove the contents from the can the consumer will normally press his lips against these metal edges while tilting the container.

The second type of pull-ring closure incorporated into the lid of a container utilizes a scored strip of metal which upon pulling upwardly pushes a portion of the strip of metal into an opening formed in the lid of the container. When utilizing this concept the tab will generally remain intact with the container, and does not create the problem of disposal of the removed pulltab as in the prior discussed container. However, regardless of which container is used neither container has solved the concerns about such containers being unsanitary, nor do they reduce the risk of cuts to the lips and tongue of the user.

Typical of efforts to improve the design of beverage containers to provide a more sanitary and safe container is disclosed in U.S. Pat. No. 4,407,425 entitled "Container Closure Lid Including Drinking Spout Means". In order to overcome the before-mentioned problems U.S. Pat. No. 4,407,425 discloses a closure lid for beverage containers having a raised boss portion integrally formed with the lid, a closure strip disposed as part of the boss portion and manually separable from the boss portion, a flexible spout member having a base portion secured within the boss portion, and a resilient drinking spout. The resilient drinking spout is folded over beneath the closure strip in a closed condition, and upwardly pivotally moveable to an open condition when the closure strip is separated from the boss portion.

While the before-mentioned container closure lid including a drinking spout, disclosed by U.S. Pat. No. 4,407,425, does address the problems of the sanitary removal of the contents of the container, and reducing the risk of cuts to the lips and tongue of the user from the metal edges defining the opening of the container, new and improved beverage containers which allow one to readily remove the contents from a beverage container in a sanitary and safe manner are highly desirable. Further, such an improvement would be even more valuable if it would allow the user the choice of using the container in the customary manner, or to withdraw the contents of the container without pressing the user's lips to the lid of the container. The present invention provides such an improvement in a novel and unobvious manner that is fully disclosed herein.

SUMMARY OF THE INVENTION

According to the present invention an improved container for beverages is provided wherein the contents of the container can be removed through the use of a flexible tubular member extendible through a pour opening formed in the container when a closure strip is separated therefrom. Broadly, the improved container of the present invention comprise a cylindrical-shaped body portion having a closed first end and a closed second end, one of the first and second ends having a pour receiving opening formed therein. The improved container further comprises a closure strip assembly for sealably closing the pour opening of the container, the closure strip assembly manually separable from at least a portion of the container so as to permit access to the contents within the container; a flexible tubular member having an extendible length greater than the overall length of the cylidrical body of the container and adapted to be extendible through the pour opening when the closure strip assembly is separated from the container; and, a stabilizing and aligning assembly for stabilizing the flexible tubular member within the container and for aligning the flexible tubular member with the pour opening so that when the closure strip assembly is detached from the container one end of the flexible tubular member is extendible through the pour opening so that the user can withdraw the contents of the container via the flexible tubular member.

An object of the present invention is to provide an improved beverage container.

Another object of the present invention, while achieving the before-stated object, is to provide an improved beverage container in which the contents therefrom can be sanitarily and safely removed.

Other objects, advantages and features of the present invention will become apparent upon reading of the following description as read in conjunction with the drawings and appended claims.

DESCRIPTION

Figure 1:
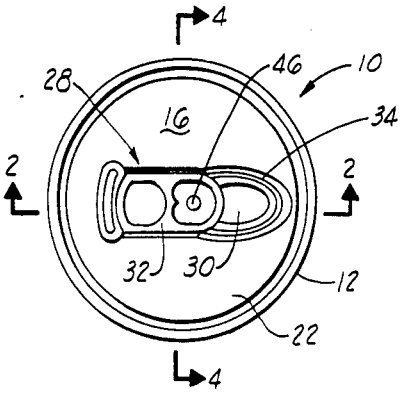
FIG. 1 is a top plan view of a beverage container illustrating a closure lid for the beverage container.

Referring to the drawings, and more specifically to FIGS. 1–4, shown therein is a beverage container 10 constructed in accordance with the present invention. The beverage container 10 comprises a cylindrical-shaped body portion 12, a first end or base 14, and a second end or closure lid 16. Any suitable means can be employed to form the base 14 and the closure lid 16 of the container 10. For example, a substantially laterally disposed first disk 18 can be sealingly connected to a first end 20 of the cylindrical-shaped body portion 12 to form the base portion 14; and a substantially laterally disposed second disk 22 can be sealingly connected to a second end 24 of the cylindrical-shaped body portion 12 to form the closure lid 16. The closure lid 16 of the container 10 is provided with a pour opening 26 therein.

Figure 2:
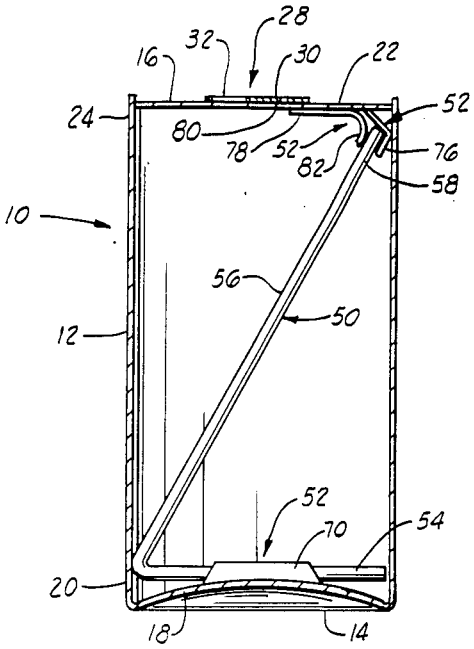
FIG. 2 is a cross sectional view of the beverage container of FIG. 1 taken along the line 2—2, wherein a closure strip assembly is in a closed condition and a flexible tubular member is stabilized within the container in a non-extended, stabilized condition.
Figure 3:
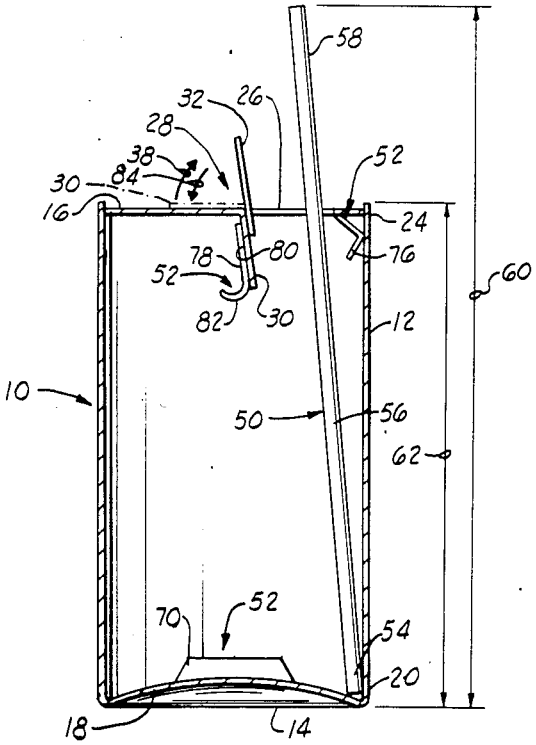
FIG. 3 is a cross sectional, view of the container of FIG. 1 wherein the closure strip assembly is in an open condition and the flexible tubular is extended through a pour opening in the lid of the container.
Figure 4:
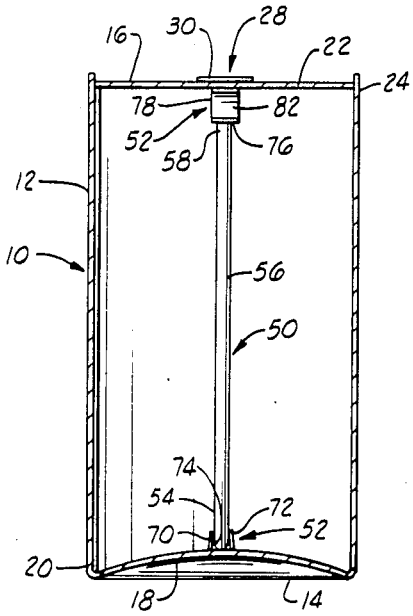
FIG. 4 is a cross sectional view of the container of FIG. 1 taken along the line of 4—4, wherein the closure strip assembly is in a closed condition and illustrating the flexible tubular member in a non-extended stabilized condition so as to be aligned with the pour opening in the lid of the container.
Figure 5:
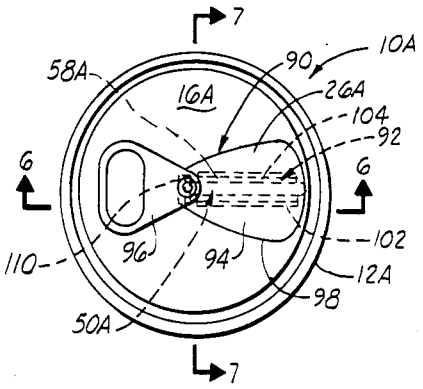
FIG. 5 is a partially broken, top plan view of a second embodiment of a beverage container illustrating a closure lid for the beverage container, and a portion of a pour opening formed therein.

A closure strip assembly 28 is connected to the closure lid 16 for sealing the pour opening 26 and providing a fluid tight container when the closure strip assembly 28 is in a closed condition, as illustrated in FIGS. 1, 2 and 4. The closure strip assembly 28 is manually separable from at least a portion of the closure lid 16 so as to be placed in an open condition (see FIG. 3) wherein the pour opening 26 is substantially unrestricted by the closure strip assembly 28, permitting access to contents within the container 10 via the pour opening 26.

The closure strip assembly 28 of the container 10 comprises a closure strip 30 and a pull-ring 32 secured to the closure strip 30. The closure strip 30 is defined by score line 34 for retaining the closure strip 30 to the closure lid 16 with a force greater than the force generated by pressure of the beverage contained in the container 10. Further, the score line 34 permits the closure strip 30 to be manually separated from the closure lid 16 so that at least a portion of the closure strip 30 to be disposed inwardly into the container 10 via tne pour opening 26 upon application of a force on the pull-ring 32 in the direction represented by the arrow 38 (FIG. 3).

The pull-ring 32 is pivotally connected to the closure lid 16, i.e. the second disk 26, by any suitable means, such as a rivet 46. The connection of the pull-ring 32 to the closure lid 16 is such that when a force is applied to the pull-ring 32 in the direction indicated by the arrow 38 the pull-ring 32 engages a portion of the closure strip 30 and separates the closure strip 30 along the score line 34.

The container 10 heretofore described is of conventional construction and widely used in the packaging of beverages, such as carbonated beverages, alcoholic beverages, and the like. However, it is to such a container, in combination with other elements and assemblies which will hereinafter be described, that the subject invention is directed. Thus, in accordance with the present invention, the container 10 further comprises a flexible tubular member 50 disposed within the container 10 and a stabilizing and aligning assembly 52 for stabilizing the flexible tube member 50 within the container 10, and for aligning the flexible tubular member 50 with the pour opening 26 so that upon removal of the closure strip 30 (via the score line 34) the flexible member 50 is extendible through the pour opening 26 as illustrated in FIG. 3.

Referring now to FIGS. 2–4, the flexible tubular member 50, an elongated member having a first end portion 54, a medial portion 56, second end portion 58, is provided with an extendible length 60 which is greater than the length 62 of the container 10. The flexible tubular member 50 is folded or coiled in a biased position within the container 10 via the stabilizing and aligning means 52 substantially as illustrated in FIGS. 2 and 4. Thus, the flexible tubular member 50 should be fabricated of a substantially inert, sterile material, such as a plastic material, having a sufficient 'memory' such that when the flexible tubular member 50 is allowed to be moved to the extended position (by removal of the closure strip 30 from sealing engagement of the pour opening 26), the flexible tubular member 50 will remain in the extended position during use. Any suitable material possessing the before-mentioned characteristics can be employed to fabricate the flexible tubular member 50 of the present invention.

The stabilizing and aligning assembly 52 of the container 10 comprises spatially disposed channel forming members 70 and 72 supported by the first disk 18 forming the first end or base 14 of the container 10 such that a channel 74 is formed therebetween. The channel 74 is adapted to receive and frictionally engage the first end portion 54 of the flexible tubular member 50 such that the medial portion 56 of the flexible tubular member 50 is in a folded or coiled position and the second end portion 58 is in a biased position substantially adjacent the second end or closure lid 16 (i.e. the second disk 22) of the container 10 substantially as shown in FIG. 2.

In order to insure that the second end portion 58 of the flexible tubular member 50 is extendible through the pour opening 26 when the closure strip 30 is detached from the second disk 26 of the container 10, the stabilizing and aligning assembly 52 further comprises a support member 76 and a retainer member 78. The support member 76 is disposed between the second disk 22 forming the second end or closure lid 16 of the container 10 and an adjacently disposed portion of the body portion 12 of the container 10 so that the support member 76, and the second end portion 58 of the flexible tubular member 50 are substantially aligned with the pour opening 26. In order to direct the movement of the second end portion 58 of the flexible tubular member 50 to the pour opening 26 (when the closure strip 30 has been removed from sealing engagement of the pour opening 26), the support member 76 is angularly disposed as illustrated in FIGS. 2 and 3.

In order to maintain the second end portion 58 of the flexible tubular member 50 in a biased, stabilized position with respect to the support member 76 when the closure strip 30 is sealingly engaging the second disk 22 to seal the pour opening 26, the retainer member 78 is connected to the closure strip 30, via an underside 80 thereof. The retainer member 78 is provided witn an arcuate-shaped end portion 82 adapted to engage the second end portion 58 of the flexible tubular member 50 when the flexible tubular member 50 is in supporting engagement with the support member 76 and the closure strip 30 is in sealing engagement with the pour opening 26. Thus, the support member 76 and the arcuate-shaped end portion 82 of the retainer member 78 cooperate to maintain the second end portion 58 of the flexible tubular member 50 in the biased position substantially adjacent the second end or closure lid 16 of the container 10; whereas, upon disengaging the closure strip 30 the arcuate-shaped end portion 82 of the retainer member 78 is directed inwardly into the container 10 and away from engagement with the flexible tubular member 50 and the support member 76. When the arcuate-shaped end portion of the retainer member 78 is disengaged from contact with the second end portion 58 of the flexible tubular member 50, the second end portion 58 of the flexible tubular member 50, because of being in a biased condition, will be moved in the direction of the pour opening 6 and at least partially extend through the pour opening 6. When the second end portion 58 of the flexible tubular member 50 has extended through the pour opening 26, an upwardly directed force applied to the second end portion 58 of the flexible tubular member 50 will cause the first end portion 54 of the flexible tubular member 50 to be removed from the channel 74 formed by the channel forming members 70 and 72. Thus, the flexible tubular member 50 is moved to its extendible position (substantially as shown in FIG. 3) so that one can readily remove the contents from the container 10 through the flexible tubular member 50.

When the contents of the container 10 have been removed, or it is determined that no further removal of the beverage is desired, the flexible tubular member 50 can be readily disposed of by forcing the flexible tubular member 50 downwardly into the container 10 via the pour opening 26. As can be appreciated, if one does not desire to drink the contents cf the container 10 through the tubular flexible member 50, the tubular flexible member 50 can be removed from the container 10. In this event, the closure strip 30 should be moved in a direction indicated by the arrow 84 until the closure strip 30 is positioned substantially adjacent the second disk 22 (substantially as illustrated in phantom in FIG. 3). Thus, if desired, one can use the container 10 to drink the contents therefrom in a customary manner without employing the flexible tubular member 50.

Referring now to FIGS. 5–8 a second embodiment of a container 10A is illustrated. The container 10A is substantially identical in construction to the container 10 heretofore described, except for the design and construction of a closure strip assembly 90, and a stabilizing and aligning assembly 92.

The beverage container 10A comprises a cylindrical-shaped body portion 12A, a first end or base 14A, and a second end or closure lid 16A. Any suitable means can be employed to form the base 14A and the closure lid 16A of the container 10A. For example, a substantially laterally disposed first disk 18A can be sealingly connected to a first end 20A of the cylindrical-shaped body portion 12A to form the base portion 14A; and can be sealingly connected to a substantially laterally disposed second disk 22A to a second end 24A of the cylindrical-shaped body portion 12A to form the closure lid 16A. The closure lid 16A of the container 10A is provided with a pour opening 26A (see FIG. 5) therein.

The closure strip assembly 90 is connected to the closure lid 16A for sealing the pour opening 26A and providing a fluid tight container when the closure strip assembly 90 is in a closed condition. The closure strip assembly 90 is manually separable from the closure lid 16A so that when the closure strip 90 is removed the pour opening 26A is in an open, unrestricted condition and permits access to the contents in the container 10A via the pour opening 26A.

The closure strip assembly 90 of the container 10A comprises a closure strip 94 and a pull-ring 96 secured to the closure strip 94. The closure strip 94 is defined by a score line 98 for retaining the closure strip 94 to the closure lid 16A with a force greater than the force generated by pressure of the beverage contained in the container 10A. Further, the score line 98 permits the closure strip 94 to be manually separated from the closure lid 16A upon application of a force on the pull-ring 96 in the direction represented by the arrow 38A (FIG. 6).

The container 10A heretofore described is of conventional construction and has been widely used in the packaging of beverages, such as carbonated beverages, alcoholic beverages, and the like. However, it is to such a container, in combination with the closure strip assembly 90, the stabilizing and aligning assembly 92, and a flexible tubular member 50A disposed within the container 10A that the subject invention is directed. Thus, in accordance with the present invention, the container 10A further comprises the flexible tubular member 50A disposed within the container 10A, and the stabilizing and aligning assembly 92 for stabilizing the flexible tube member 50A within the container 10A such that one end portion of the flexible tubular member 50A is aligned with the pour opening 26A formed in the closure lid 16A of the container 10A. Thus, upon removal of the closure strip 94, via the score line 98, the end portion of the flexible member 50A is extendible through the pour opening 26A substantially as illustrated in phantom in FIG. 6.

Figure 6:
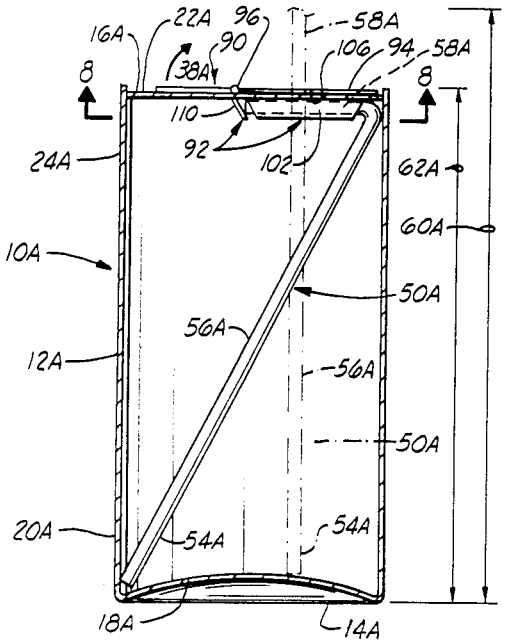
FIG. 6 is a cross sectional view of the container of FIG. 5 taken along the line 6—6, wherein the flexible tubular member is in a non-extended, stabilized condition when a closure strip assembly of the container is in a closed position, and illustrating, by phantom lines, the flexible tubular member in an extended condition when the closure strip assembly is removed.
Figure 7:
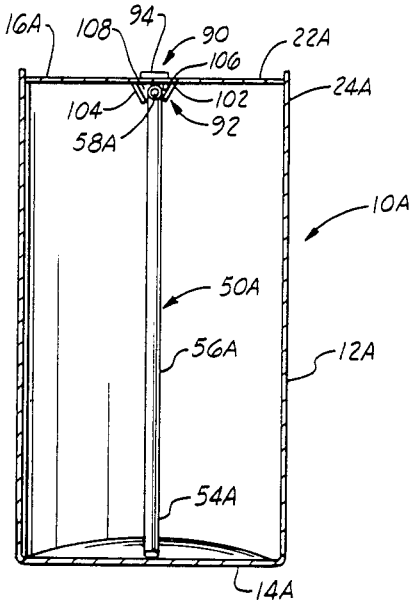
FIG. 7 is a cross sectional view of the container of FIG. 5 taken along the line 7—7 wherein the flexible tubular member is in a non-extended, stabilized condition when the closure strip assembly of the container is in the closed position.
Figure 8:
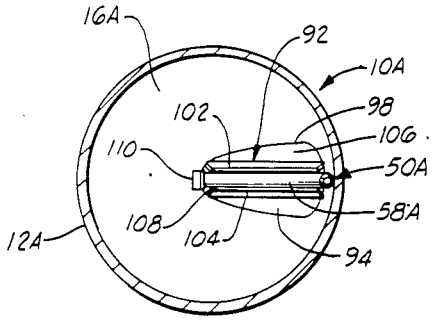
FIG. 8 is a cross sectional view of the container of FIG. 6 taken along the line 8—8, and illustrating a stabilizing and aligning assembly for aligning one end of the tubular member with a pour opening of the container.

Referring now to FIGS. 6–8, the flexible tubular member 50A, an elongated member having a first end portion 54A, a medial portion 56A, and a second end portion 58A, is provided with an extendible length 60A which is greater than the length 62A of the container 10A. The flexible tubular member 50A is folded or coiled in the container 10A and stabilized in position by the stabilizing and aligning means 92 substantially as illustrated in FIG. 6. Thus, the flexible tubular member 50A should be fabricated of a substantially inert, sterile material, such as a plastic material, having a sufficient 'memory' such that when the flexible tubular member 50A is allowed to be moved to the extended position by removal of the closure strip 94 from sealing engagement with the closure lid 16A, the flexible tubular member 50A will remain in the extended position during use. Any suitable material possessing the before-mentioned characteristics can be employed to fabricate the flexible tubular member 50A.

The stabilizing and aligning assembly 92 of the container 10A comprises spatially disposed channel forming members 102 and 104 supported by the closure strip 94 via an underside 106 thereof such that a channel 108 is formed therebetween. The channel 108 is adapted to receive and frictionally engage the second end portion 58A of the flexible tubular member 50A such that the medial portion 56A of the flexible tubular member 50A is in a folded or retracted position in the body portion 12A of the container 10A, and the first end portion 54A of the flexible tubular member 50A is disposed substantially adjacent the first end or base 14A (i.e. the first disk 18A) of the container 10A substantially as shown in FIG. 6.

To maintain the second end portion 58A of the flexible tubular member 50A in a stabilized position within the channel 108 when the closure strip 94 is sealingly engaging the closure lid 16A to seal the pour opening 26A, the stabilizing and aligning assembly 92 further comprises a retainer or stop member 110 connected to the closure lid 16A so as to be spatially disposed to the channel forming members 102, 104 and aligned with the channel 108. The retainer member 110 is preferably angularly disposed, substantially as shown in FIG. 6, so that the retainer member 110 cooperates with the channel forming members 102 and 104 to maintain the second end portion 58A of the flexible tubular member 50A in a position substantially adjacent the closure strip 94 of the closure strip assembly 90. Thus, upon removal of the closure strip 94 the second end portion 58A of the flexible tubular member 50A is directed upwardly through the pour opening 26A in the closure lid 16A of the container 10A. The second end portion 58A of the flexible tubular member 50A can then be manually removed from the channel 108 formed by the channel forming members 102 and 104 of the closure strip assembly 90, and the closure strip assembly 90 is discarded. The flexible tubular member 50A, when positioned in its extended position (substantially corresponding to the extended position illustrated in phantom in FIG. 6), permits one to remove the contents from the container 10A through the flexible tubular member 50A.

When the contents of the container 10A have been removed, or it is determined that no further removal of the beverage is desired, the flexible tubular member 50A can be forced downwardly into the container 10A via the pour opening 26A to dispose of the flexible tubular member 50A. As can be appreciated, if one does not desire to drink the contents of the container 10A through the tubular flexible member 50A, the tubular flexible member 50A can be removed from the container 10A, and discarded. Thus, if desired, one can use the container 10A to drink the contents therefrom in a customary manner without employing the flexible tubular member 50A.

It is clear that the present invention is well adapted to carry out the objects and attain the ends and advantages mentioned herein as well as those inherent in the invention. While presently preferred embodiments of the invention have been described for the purposes of this disclosure, numerous changes may be made which will readily suggest themselves to those skilled in the art and which are accomplished within the spirit of the invention disclosed and as defined in the appended claims.

What is claimed is:

1. An improved container for beverages comprising:

a cylindrical body member having a first end and a second end;

a substantially laterally disposed first disk sealingly connected to one of the first and second ends of the cylindrical body;

a substantially laterally disposed second disk sealingly connected to the other of the first and second ends of the cylindrical body member, the second disk having a pour opening formed therein;

closure strip means supported by the second disk for sealingly closing the pour opening, the closure strip means manually separable from at least a portion of the disk so as to permit access to contents within the container via the pour opening, said closure strip means comprising:

a closure strip and a pull ring supported by the closure strip, the closure strip being defined by a scored line for retaining the closure strip to the second disk with a force greater than the force generated by pressure of the beverage contained in the container, the closure strip further characterized as having an underside facing the contents of the container when retained by the scored line, the pull-ring being pivotally connected to the second disk such that upon application of an upwardly directed force on the pull-ring one end portion of the pull-ring engages the closure strip and directs at least a portion of the closure strip in a downwardly direction so as to separate same along the scored line and cause the closure strip to be moved inwardly into the container so as to substantially unrestrict the pour opening;

a flexible tubular member disposed within the container so as to be flexible through the pour opening when the closure strip means is separated from the second disk, the flexible tubular member having a first end portion, a second end portion, and an extendible length greater than the length of the cylindrical body; and stabilizing and aligning means for stabilizing the flexible tubular member within the container and for aligning the flexible tubular member with the pour opening such that upon removal of the closure strip means one end portion of the flexible tubular member is extendible through the pour opening, said stabilizing and aligning means comprising:

a pair of spatially disposed channel forming members supported by the first disk so as to be disposed within the container, the spatially disposed channel forming members defining a channel therebetween adapted to receive and stabilize the first end portion of the flexible tubular member in a position substantially adjacent the first disk;

a support member supported by the second disk and the adjacent end of the cylindrical body of the container so as to be substantially aligned with the pour opening, the support member supportingly engaging the second end portion of the flexible tubular member; and a retainer member supported by the closure strip via the underside thereof, the support member and the retainer member cooperating to maintain the second end portion of the flexible tubular member in a biased position substantially adjacent the second disk such that upon disengaging the closure strip from at least a portion of the second disk the second end portion of the flexible tubular member is directed to the pour opening and extendible through the pour opening a sufficient distance to permit disengagement of the first end portion of the flexible tubular member from the channel formed by the spatially disposed channel forming members.

2. In a container for beverages wherein the container is provided with a body portion, a first end sealingly connected to one end of the body portion so as to form a base for the container, a second end having a pour opening formed therein sealingly connected to the other end of the body portion so as to form a lid, and a closure strip having a pull ring supported thereby, the closure strip sealing the pour opening and adapted to be manually separable from at least a portion of the lid so as to substantially unrestrict the pour opening, the closure strip characterized as having an underside facing the contents of the container when in a sealing relationship with the pour opening, the closure strip being defined by a scored line for retaining the closure strip to the lid with a force greater than the force generated by pressure of the beverage contained in the container while permitting at least a portion of the closure strip to be disposed inwardly into the container via the pour opening upon application of an upwardly directed force on the pull ring, the improvement comprising:

a flexible tubular member disposed within the container so as to be extendible through the pour opening when the closure strip means is separated from sealing engagement with the lid along the scored line such that a portion of the closure strip means is disposed inwardly into the container, the flexible tubular member having a first end portion, a second end portion, and an extendible length greater than the length of the cylindrical body; and stabilizing and aligning means for stabilizing the flexible tubular member within the container and for aligning the flexible tubular member with pour opening such that upon removal of the closure strip means one end portion of the flexible tubular member is extendible through the pour opening, said stabilizing and aligning means comprising:

a pair of spatially disposed channel forming nembers supported by the first base of the container so as to be to be disposed within the container, the spatially disposed channel forming members defining a channel therebetween adapted to receive and stabilize the first end portion of the flexible tubular member in a position substantially adjacent the base of the container;

a support member supported by the lid of the container and the adjacent end of the body portion of the container so as to be substantially aligned with the pour opening, the support member supportingly engaging the second end portion of the flexible tubular member; and a retainer member supported by of the closure strip via the underside thereof, the support member and the retainer member cooperating to maintain the second end portion of the flexible tubular member in a biased position substantially adjacent the lid of the container such that upon disengaging the closure strip from at least a portion of the lid of the container the second end portion of the flexible tubular member is directed to the pour opening and extendible through the pour opening a sufficient distance to permit disengagement of the first end portion of the flexible tubular member from the channel formed by the spatially disposed channel forming members.

* * * * *